US005843559A

United States Patent [19]

Cadieux et al.

[11] Patent Number: 5,843,559

[45] Date of Patent: Dec. 1, 1998

[54] INSULATING FIBER MAT HAVING INCLINED FIBERS ON OPPOSED SIDES OF A CENTRAL HORIZONTAL PLANE

[75] Inventors: Serge Cadieux, Pierrefonds; Yvon L'Heureux, Cap-de-la-Madeleine; Stéphane St-Cyr, Trois-Rivières W.; Marcel Dubé , Cap-de-la-Madeleine; Daniel Frenette, Iles Laval; Berthier Roy, Danville, all of Canada

[73] Assignees: Group Laperrier et Verreault, Inc., Trois-Rivieres; Cascades Inc., Kingsey Falls, both of Canada

[21] Appl. No.: 978,054

[22] Filed: Nov. 25, 1997

Related U.S. Application Data

[62] Division of Ser. No. 345,638, Nov. 28, 1994, Pat. No. 5,766,531.

[51] Int. Cl.[6] ..... B32B 5/12

[52] U.S. Cl. ..... 428/113; 428/105; 428/218

[58] Field of Search ..... 428/105, 113, 428/218

[56] References Cited

U.S. PATENT DOCUMENTS

| | | | |
|---|---|---|---|
| 4,629,523 | 12/1986 | Wetterwald et al. | 428/113 |
| 4,883,700 | 11/1989 | Harpell et al. | 428/113 |
| 5,326,614 | 7/1994 | Doose | 428/113 |
| 5,472,767 | 12/1995 | Neubauer | 428/113 |
| 5,506,018 | 4/1996 | Jacob et al. | 428/113 |

*Primary Examiner*—James J. Bell
*Attorney, Agent, or Firm*—Swabey, Ogilvy, and Renault

[57] ABSTRACT

An insulating fiber mat is comprised of a plurality of fibers bound together by a binder means and distributed throughout the mat. At least some of the fibers throughout the mat are inclined. The inclined fibers on opposed sides of a central horizontal plane of the mat have opposed angles of inclination. This permits the fiber mat to be easily separated substantially along the central horizontal plane by applying a pulling force on one side of the mat in the direction of the inclined fibers.

8 Claims, 3 Drawing Sheets

FIG. 1

INSULATING FIBER MAT HAVING INCLINED FIBERS ON OPPOSED SIDES OF A CENTRAL HORIZONTAL PLANE

This application is a division of application Ser. No. 08/345,638, filed Nov. 28, 1994, now U.S. Pat. No. 5,766, 531.

TECHNICAL FIELD

The present invention relates to a fiber mat having inclined fibers on opposed sides of a central horizontal plane whereby to permit the mat to be separated along that plane by applying pulling force on one side of the mat in the direction of the inclined fibers.

BACKGROUND ART

Known air forming systems for the fabrication of mats are limited in capacity to an output of about 500 kg/hr and can form webs having a maximum thickness of about 5 cm. The reason for such limitation is the formation length of the existing forming systems. Their formation length is also limited to 20 cm in length along the machine direction because air flow cannot be expanded to form larger surface areas without affecting the web formation. Too large an expansion in the forming surface creates air flow boundaries layer separation in the former which affects the web formation profile. The thickness of the web being formed is also limited because a high angle of formation of the inclined fiber pile on the suction portion of the machine creates shingle effect in the web. The shingle effect is caused by the deposit of the fibers at an angle on the fiber pile deposited on the suction surface.

Another disadvantage of the prior art formers, often referred to as vertical formers, is that the air formation of the web, for the entire thickness of the web in the vertical direction, has the tendency to compress the fibers especially in the bottom section of the web. In other words, the density of the web at the bottom is considerably higher than the density at the top, i.e. from 1 to 3 lbs/cu. ft. Because these webs are formed with the fibers distributed at a common angle from top to bottom, it is difficult to split the web along planar areas for positioning same behind pipes or wires in walls, as the web tends to break in pieces as they tear along the shingling direction, along the angulated fibers and in a 6-inch mat the fiber angle can extend along a length of about 2 ft from opposed sides of the mat.

Various forming machines are known to form cellulosic fiber mats or the like for the formation of thermal or acoustical mats or the formation of fiber boards. A disadvantage of such machines, for example as described in U.S. Pat. No. 4,035,121 issued Jul. 12, 1977, is that they have limited fiber handling capacity. That is to say, they cannot utilize sufficient fibers to form thick mats as the fibers are usually deposited in a vertical downward air-flow onto a collecting surface which is displaceable usually in a transverse plane. Therefore, these machines have the limitation that only a certain quantity of fibers can be accumulated onto the forming built and such have been found adequate to form mats of small thicknesses in the range of up to about 2 inches. Because of that, when a larger thickness is required, it is necessary to have a two or three stage or multiple stage former in order to produce two or more layers of fiber mats and then these mats have to be brought together and somehow adhered or encapsulated in order to provide a mat of sufficient thickness to meet a required insulation factor. In order to fabricate fiber boards, it is also necessary to have at least a two or three stage former and the mats produced thereby have to be adhered somehow before being compressed. The result of this is that the forming machines are very expensive and this increases cost of the end product, i.e. the fiber board. A still further disadvantage is that because the fiber board is formed from multiple mats of wood fibers, it is often difficult to mold the shape of the fiber boards after its fabrication due to the fact it will crack along the form area due to the fact it is formed of various layers wherein fibers are distributed in layer form and do not extend across the board or random distributed throughout the thickness of the board.

SUMMARY OF INVENTION

It is a feature of the present invention to provide a fiber mat, a forming machine and a method of fabrication of the mat which substantially overcomes the above disadvantages of the prior art.

Another feature of the present invention is to provide a fiber mat forming machine having two separate forming surfaces, one horizontal and one vertical, capable of producing a fiber mat which can be easily separated along a substantially central horizontal plane when used as an insulating mat.

Another feature of the present invention is to provide a novel method of fabricating a fiber mat which can be easily separated along a substantially central horizontal plane when used as an insulating mat.

Another feature of the present invention is to provide a fiber mat having inclined fibers on opposed sides of a substantially horizontal plane with the angle of inclination of the fibers extending at opposed angles of inclination.

Another feature of the present invention is to provide a fiber mat having sufficient weight and thickness to permit compression thereof to form fiber boards.

Another feature of the present invention is to provide a fiber mat forming machine which can produce mats having improved density profile, and which can be controlled to vary the thickness of the mat as well as the density of the fibers therein.

According to a broad aspect of the present invention there is provided an insulating fiber mat comprising a plurality of fibers bound together by binder means and distributed throughout the mat. At least some of the fibers throughout the mat are inclined. The inclined fibers on opposed sides of a central horizontal plane of the mat have opposed angles of inclination whereby the mat can be easily separated substantially along the junction plane by applying a pulling force on one side of the mat in the direction of the inclined fibers.

BRIEF DESCRIPTION OF DRAWINGS

A preferred embodiment of the present invention will now be described with reference to the accompanying drawings in which.

DESCRIPTION OF PREFERRED EMBODIMENTS

Figures 1, 2:
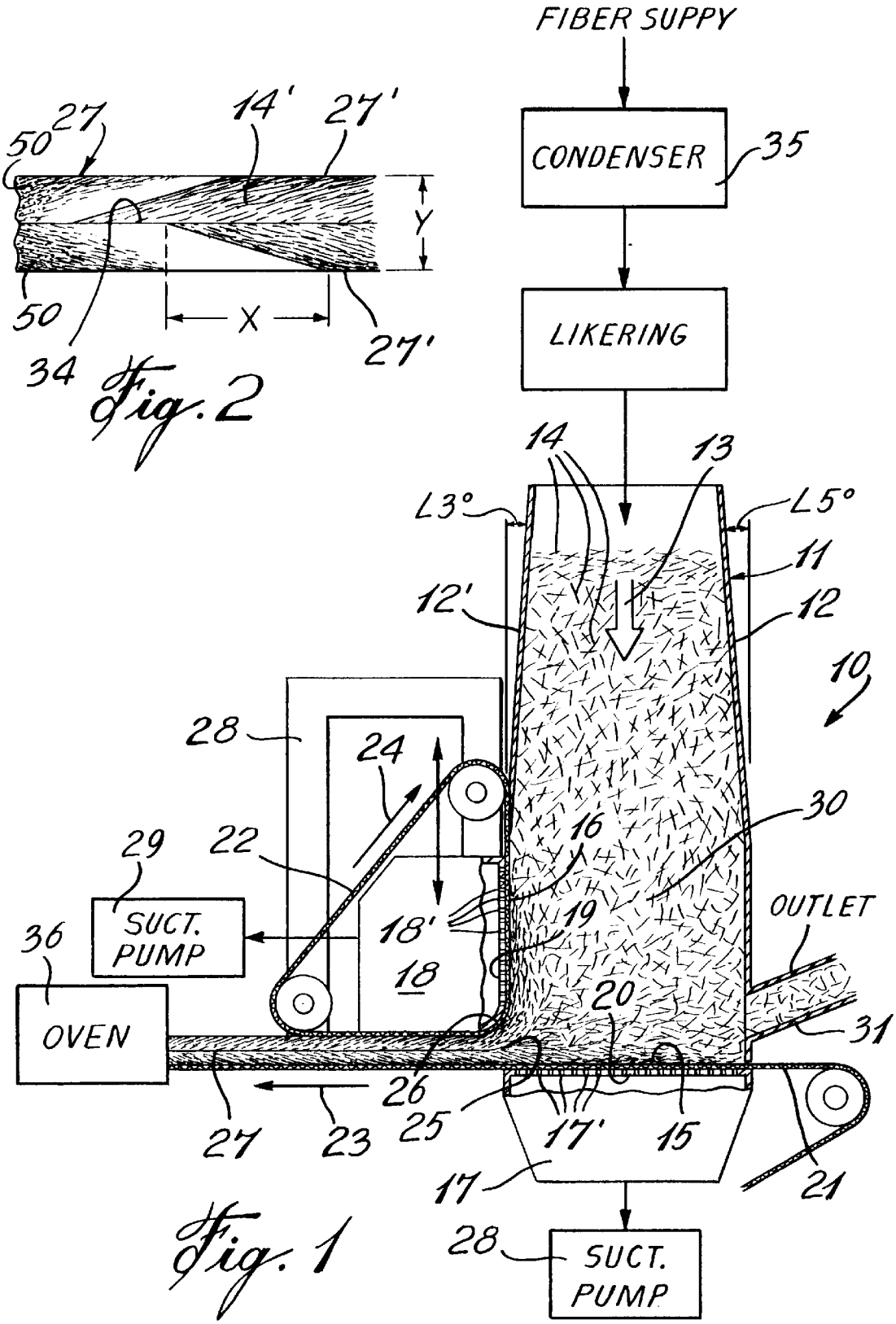
FIG. 1 is a simplified schematic view illustrating the construction of the fiber mat forming machine of the present invention.
FIG. 2 is a simplified section view showing the distribution of fibers within the fiber mat of the present invention where fibers are inclined at opposed directions on each side of a substantially central horizontal plane of the mat.
Figure 3:
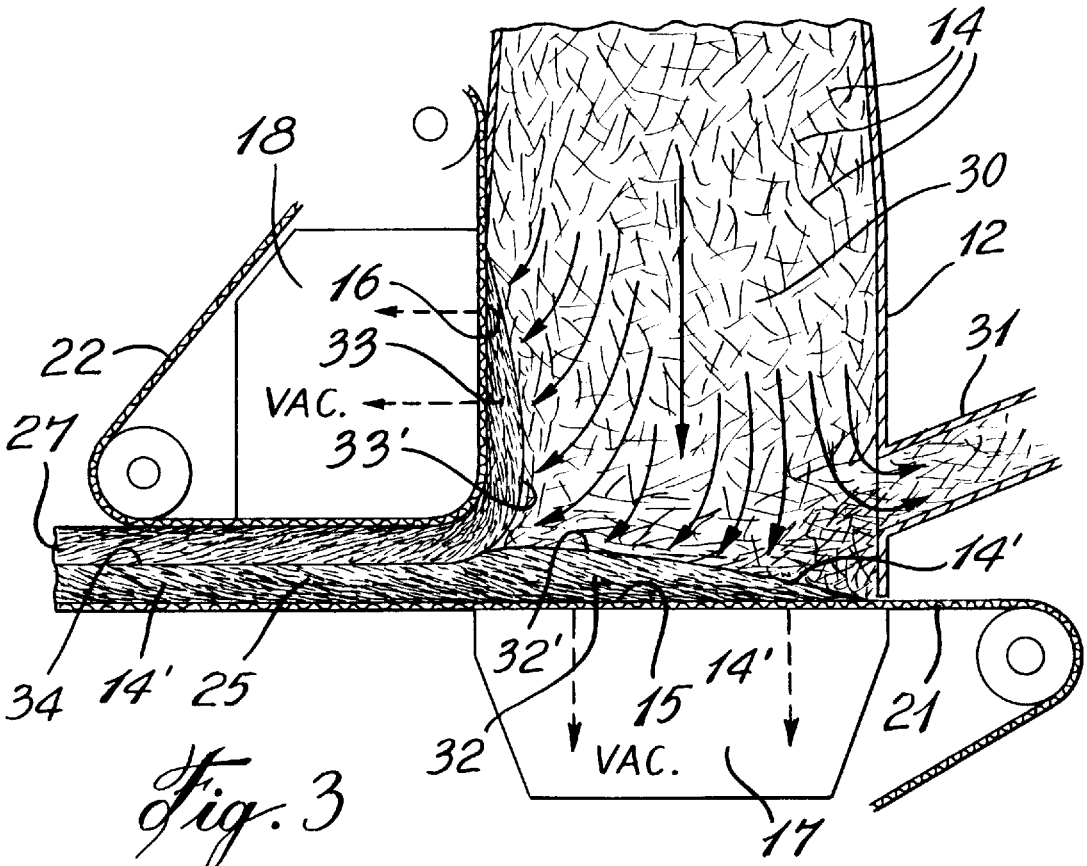
FIG. 3 is a simplified schematic view showing the method of formation of the fiber mat of the present invention by depositing fibers on inclined fiber piles adjacent a horizontal and a vertical forming surface in a bottom portion of a vertical chute.

Referring to the drawings, and more particularly to FIGS. 1 to 3, there is shown generally at 10 the fiber mat forming machine of the present invention. The forming machine is comprised of a diffuser formed as a vertical chute 11 having angulated side walls 12 and 12' through which a downward air flow, as indicated by arrow 13, is maintained and carries substantially uniformly distributed fibers 14. As herein shown, the side walls 12' are angled at 3°. The maximum angulation about the diffuser cannot exceed 7°, as is well known in the art, in order to be efficient. The vertical chute also has opposed side walls that are angulated in the diffuser section. The bottom of the chute is herein shown as having a straight side wall section where the fibers are collected.

A flat horizontal forming surface 15 is provided at the base of the chute and a flat vertical forming surface 16 is provided adjacent an end of the horizontal forming surface and spaced thereabove and constitute a side wall. A suction box 17 is disposed under the horizontal forming surface 15 and a suction box 18 is disposed behind the vertical forming surface 16. These suction boxes are divided into suction sections 17' and 18'. A perforated metal plate 19 is disposed over the suction chamber 18', and a perforated plate 20 is disposed over the suction chamber 17'.

A first conveyor belt 21 is displaced over the perforated flat plate 20 or the forming surface 15 and a second conveyor belt 22 is displaceable over the perforated metal plate 19 of the vertical forming surface 16. These conveyor belts are constructed from a weave of synthetic fibers, herein polyester and nylon fibers, having a predetermined mesh count to permit the passage of air therethrough and the retention of fibers thereon. The conveyor belts 21 and 22 are driven in the direction of arrows 23 and 24, respectively, and towards a mat forming port 25 which is disposed below a lower curved portion 26 of the vertical forming surface 16. These belts 21 and 22 are in spaced apart parallel relationship at the mat forming port 25 and the spacing therebetween determines the thickness of a fiber mat 27 to be formed. In order to adjust the thickness of the fiber mat the entire assembly, which forms the vertical forming surface 16, is adjustably secured to a support frame 28 whereby the vertical suction box 18 may be lowered or raised along a vertical axis.

In order to draw the fibers 14 contained within the air stream 13 against the forming surfaces 16 and 15, the suction boxes 17 are each connected to a respective suction fan 28 and 29, respectively, whereby air from the inner chamber 30 in the lower section of the likering is drawn in the direction of the forming surfaces so that fibers may be collected on the conveyor belts 21 and 22. FIG. 3 illustrates the air flow in the inner chamber 30 of the lower section of the likering (the chute) and, as can be seen, there is further provided a fiber drawing port 31 or a return outlet disposed in the bottom portion of the side wall 12 adjacent the conveyor belt 21 which is displaced over the horizontal forming surface.

Because the belts are displaced towards the mat forming port 25, the fibers build up over the forming surfaces on an inclined fiber pile 32 against the horizontal forming surface 15 and pile 33 along the vertical forming surface 16. These piles increase in thickness towards the mat forming port 25, as clearly shown in FIG. 3, and this thicker end of the fiber pile is continuously drawn through the port 25 by the conveyor belts 21 and 22 which operate at the same rate of displacement. The rate of displacement of the conveyor belt depends on the thickness of the mat to be formed and the velocity of the downward fiber air flow.

As can also be seen, the adjacent top surfaces 32' and 33' of the fiber piles 32 and 33 are mated together and form a substantially central plane 34 of the mat 27 by superimposition of the piles. Because the outer surfaces 32' and 33' are sloped, when the fibers 14 deposit on these surfaces they lie on a slope and are angulated within the piles in the manner as illustrated by the fibers 14' within the piles. Accordingly, the fibers within the mat 27 are distributed at opposed angles of inclination on each side of the horizontal central plane 34, as more clearly shown in FIG. 2.

With particular reference to FIG. 2, the mat 27 therein shown has a thickness "y" of 6 inches with the central horizontal plane 34 located at a depth of about 3 inches from opposed flat horizontal surfaces 27' of the mat. The inclined fibers 14' on opposed sides of the central horizontal plane 34 provide an angle of separation "x" which extends about 24 inches along one of the mat half sections which extends from one of the flat horizontal surface 27' to the central plane 34. The juncture plane 34 of the mat may not necessarily be at substantially the center of the mat as it could be offset considerably. The location of this plane is controllable by controlling the suction in the suction boxes 17 and 18 and the speed of the conveyor belts 21 and 22 as well as the size of the port 25.

The fibers 14 contained with the air stream 13 may be cellulosic or synthetic fibers, or combinations of these, for the fabrication of the fiber mat which may be used as an acoustical or thermal insulating mat, or both or may have other uses. These fibers come from a supply which is fed to a condenser 35 where the mixed fibers are injected in an air stream and conveyed in suspension into the likering which is designed to achieve a substantially uniform distribution of fibers within the downward air stream 13. Accordingly, there is formed a fiber mat 27 of loose distributed fibers to form thermal or acoustical insulating mats or fiber boards by compressing the thick mats.

In the particular embodiment shown in FIG. 1, the fibers within the air stream comprise short loose fill cellulose fibers and longer bonding synthetic fibers in substantially predetermined volumes. Because these fibers are deposited on the angulated fiber piles 32 and 33, the majority of the fibers, particularly the longer bonding synthetic fibers, are inclined within the mat. In order to bind these fibers together the fiber mat 27 is fed to an oven 36 wherein the fiber mat is subjected to a predetermined temperature whereby the bonding synthetic fibers will heat-fuse together at crossing contact points to form a matrix defining pockets for trapping and retaining the loose fill cellulose fibers therein and throughout the mat. Of course, if the fibers are long synthetic fibers or fiberglass fibers, they may be bound together by a powder glue mixed therewith.

Figure 4:
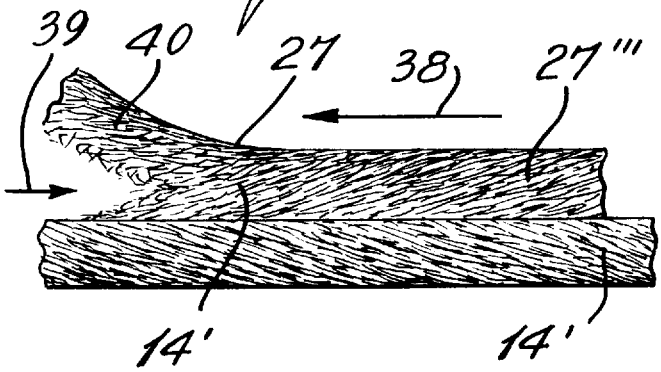
FIG. 4 is a fragmented section view of the mat of the present invention knowing the resistance to tear offered by the angulated fibers adjacent the horizontal central plane of the mat.
Figure 5:
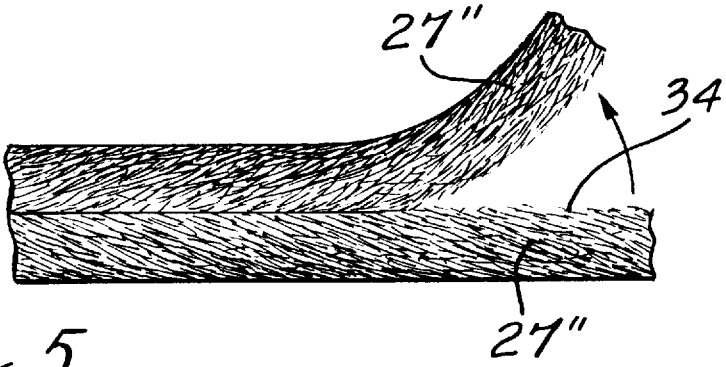
FIG. 5 is a fragmented section view showing how the mat is separated in half along the direction of the inclined fibers.
Figure 6:
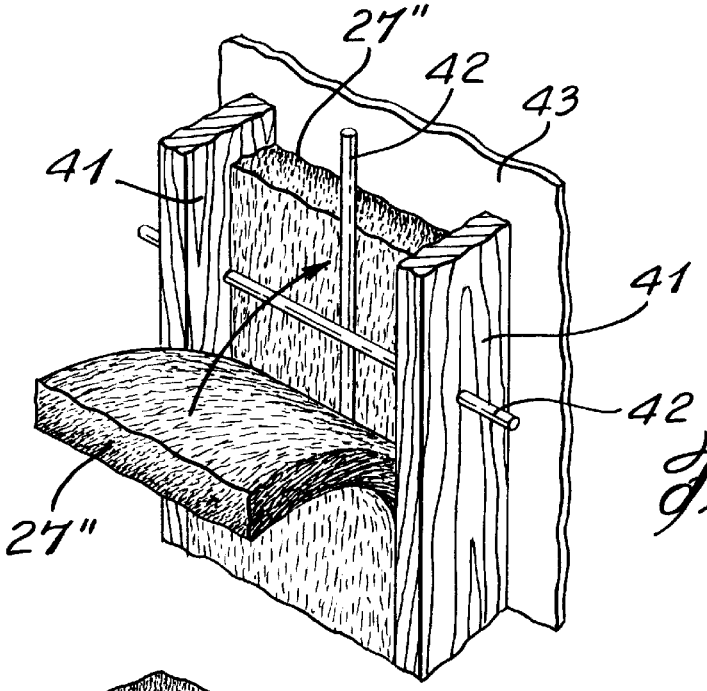
FIG. 6 is a fragmented perspective view showing how the mat is separated for positioning behind wires or pipes extending between studs in a wall construction.

Referring now to FIGS. 4 to 6, it can be seen that an advantage of forming a fiber mat with opposed angulated fibers 14' on opposed sides of a juncture plane of the mat provides the advantage that the mat can be easily separated in two sheets 27", as shown in FIG. 5, and substantially along the horizontal juncture plane 34. However, this can be done only if the one of the sheets or both sheets are pulled apart in the direction of the angulated fibers, as depicted by arrow 38 in FIG. 4. As shown in FIG. 4, if one were to attempt to rip through the mat 27 in the opposite direction, as shown by arrow 39, it would not take place across the mat for the reason that the angulated fibers 14' in the mat portion 40' would direct the tearing force, in the direction of arrow 39 and across the mat section 27". Accordingly, if an attempt to split the fiber mat in a direction opposed to arrow 38, as shown at 40, these would be a tendency to tear along the angulated plane of the fibers toward the side of the mat, and the mat will not split in the central plane because the fibers are oriented in a counter direction.

Figure 7:
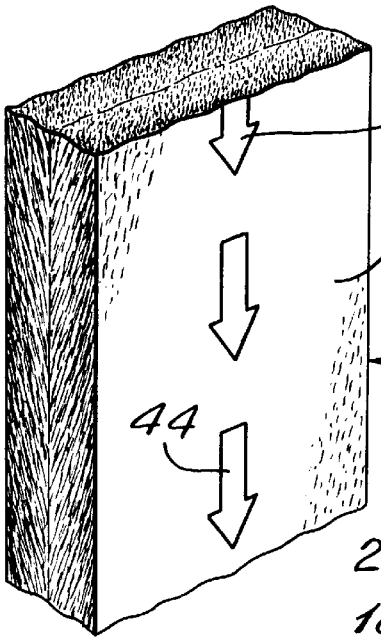
FIG. 7 is a fragmented perspective view showing a mat having indicator means spray-painted thereon to indicate the direction of inclination of the fibers and hence the direction in which the fiber mat can be pulled apart to separate same along the central horizontal plane thereof.

An advantage of being able to split the mat along its central plane is illustrated in FIG. 6. As can be seen, when installing such mat 27 between construction joists 41 in a building frame, which is a common use, it is often necessary to position insulation behind wires or pipes 42 which usually run across the joists 41 spaced from the back wall 43 thereof. With the mat of the present invention all that needs to be done is to separate the mat in half sections and to place one half of the mat, or a portion thereof, behind the pipe or wire 42 and the other half 27", or portion thereof, thereover. Accordingly, there is provided uniform insulation across the joist in the area of the pipe or wire. In order to facilitate the splitting of the mat indicator means in the form of arrows 44 may be spray-painted on the opposed surfaces 27' of the mat 27 as shown in FIG. 7.

It is also pointed out that with the forming machine of the present invention it is possible to adjust the density of the fibers within the mat by controlling the suction fans 28 and 29 to vary the amount of suction or air displacement through the conveyor belts displaceable over the horizontal and vertical forming surfaces. Because the fibers are distributed in piles there will be more fibers at the bottom of the piles, that is to say, closer to the conveyor belts than on top of the piles. Accordingly, when the mat is formed there is a higher fiber density close to the outer surfaces 27' of the mat, as illustrated in FIG. 2 by reference numeral 50. Accordingly, the mat is weaker in the central plane 34 where the fibers are less dense (fewer fibers) and facilitates the separation of the mat in two substantially equal mat sections. By varying the density we can, of course, control the R value of the mat if it is used for thermal insulation, or the acoustic value if it is used as an acoustic insulating mat. It is also pointed out that, because there are two forming surfaces in the bottom section of the likering, the former provides a double output capacity and therefore gives a higher production. Also, because the mat is formed of two sections wherein the piles are less thick than if it was only formed in the horizontal section, the angle of formation is split by the two sections, each of which is only half the thickness of the mat and therefore less shingle effect. It also results in lower fiber density in the surfaces as the piles on each belt are less thick, and accordingly there is less pressure on the fibers to compact on the conveyor surfaces.

Figure 8:
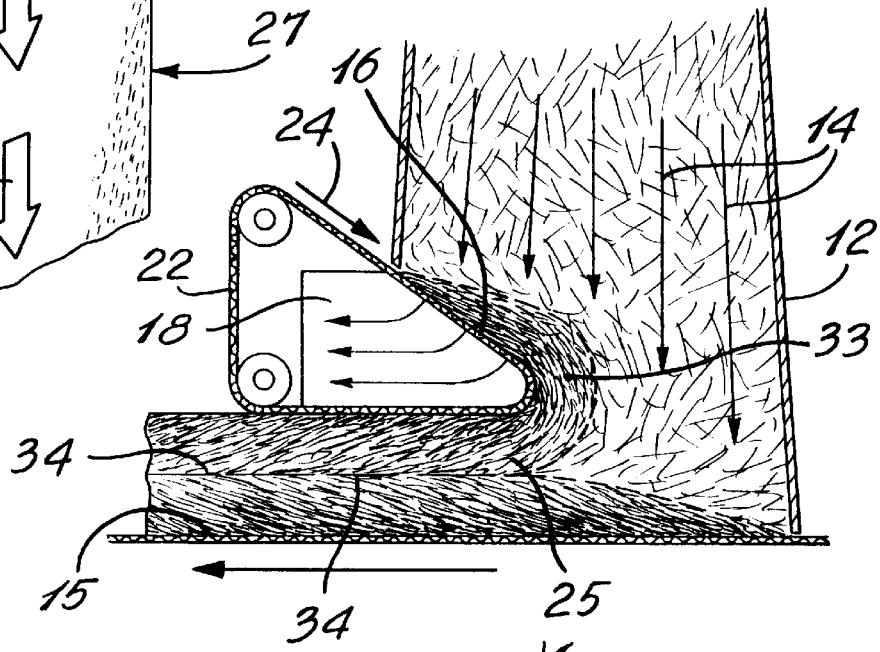
FIG. 8 is a simplified schematic view illustrating a modification of the horizontal former which extends at an angle to the horizontal forming surface.

FIG. 8 shows a modification of the forming machine and wherein the flat vertical forming surface 16 is disposed at an angle with respect to the horizontal forming surface 15. The second conveyor belt 22 is also displaced in the direction of arrow 24 towards the horizontal belt 15 and the build-up of fibers produce the pile 33 similar to that as shown in FIG. 3. It is also pointed out that forming port 25 may be adjusted as well as the vacuum pressure in the section boxes 17 and 18 whereby the juncture plane 34 is not substantially at the center of the mat but could be offset substantially. The invention is therefore not restricted to the formation of a mat having a juncture plane which is central.

Briefly summarizing the method of fabrication of the mat, there is comprised the steps of providing a downward air flow in a containment chute of a likering and in which there is distributed the fibers in a substantially uniform manner. These fibers 14 are drawn against a first conveyor belt 21 which is displaceable over the bottom flat horizontal forming surface 15 and simultaneously fibers are drawn against the second conveyor belt 22 which is displaced over the flat vertical forming surface 16 adjacent one end of the horizontal forming surface 15 and spaced thereabove to form a mat forming port 25 therebetween. The second endless belt 22 is guided in an endless loop, as shown in FIG. 1, between by guide rolls and other guide means which may be associated with the forming surface so that the belt is maintained in position over the vertical forming surface. This entire assembly is also adjustable vertically to vary the thickness of the web, as above described. Suction is applied through the horizontal and vertical forming surfaces and their associated conveyor belts to draw the fibers against the belts where the fibers deposit on an inclined fiber pile which increases in thickness in the belt conveying direction towards the mat forming port where the thicker end of the fiber pile is located. These fiber piles are then drawn from the thicker end through the mat forming port 25 by the displacement of the conveyor belts, and adjacent top surfaces of the piles are mated and form a juncture plane through a mat which is formed by superimposing these piles with the fibers on opposed sides of the central plane distributed at opposed angles of inclination. The former thus produces very thick fiber mats as it has two forming surfaces. Such thick mats can then be compressed to form fiber boards, which was not possible with prior art formers.

The method also comprises the step of drawing some of the downward air flow and fibers adjacent an end of the horizontal forming surface opposite the mat forming port to obtain a desired profile of the inclined fiber deposits on the horizontal and vertical forming surfaces and to maintain a proper flow of fibers within the lower section of the former. The method also comprises controlling the suction force through the horizontal and vertical forming surfaces to adjust the density of the fibers within the piles, and hence the mat. Finally, the method also comprises feeding the mat through a temperature controlled chamber or oven to fuse or bind the fibers together to form a self-supporting insulating mat. A power glue may be mixed with the fibers depending on the type of fibers used.

The method also envisages forming a mat for the production of fiber boards. After the mat exits from the former port 25, it is then fed to a compressor where the mat is then compressed in fiber board. It can then be fed to a slitter to be slit in boards of uniform sizes. The boards may then be coated with a protective coating.

It is within the ambit of the present invention to cover any other obvious modifications of the preferred embodiment described herein, provided such modifications fall within the scope of the appended claims.

We claim:

1. An insulating fiber mat comprising a plurality of fibers bound together by binder means and distributed throughout the mat, at least some of said fibers throughout said mat being inclined, said inclined fibers on opposed sides of a central horizontal plane of said mat having opposed angles of inclination whereby said mat can be easily separated substantially along said central horizontal plane by applying a pulling force on one side of said mat in the direction of said inclined fibers.

2. An insulating fiber mat as claimed in claim 1 wherein there is a higher density of fibers towards opposed flat horizontal surfaces of said mat, said density of fibers diminishing towards said central plane on opposed sides thereof.

3. An insulating fiber mat as claimed in claim 2 wherein said fibers in said mat comprise loose fill short cellulose fibers and longer bonding synthetic fibers, at least a majority of said bonding synthetic fibers being inclined fibers, said bonding synthetic fibers being heat-fused at crossing contact points to form a matrix having pockets for retaining said loose fill cellulose fibers therein and throughout said mat.

4. An insulating fiber mat as claimed in claim 1 wherein said mat has a thickness of about 6 inches with said central horizontal plane located at a depth of about 3 inches from opposed flat horizontal surfaces of said mat, said inclined fibers on opposed sides of said central horizontal plane providing an angle of separation extending about 24 inches along said mat portion from one of said flat horizontal surfaces to said central plane.

5. An insulating fiber mat as claimed in claim 1 wherein said mat is a thermal insulation mat.

6. An insulating fiber mat as claimed in claim 1 wherein said mat is an acoustical insulation mat.

7. An insulating fiber mat as claimed in claim 2, wherein indicator means is provided on said opposed flat horizontal surfaces of said mat to indicate the direction of inclination of said inclined fibers.

8. A fiber mat for producing a fiber board, said board comprising a plurality of fibers bound together by binder means and distributed throughout said mat, at least some of said fibers throughout said mat being inclined, said inclined fibers on opposed sides as a juncture plane of said mat having opposed angles of inclination whereby said mat is a double-formed mat of increased thickness sufficient to be compressed into a fiber board.

* * * * *